US005749378A

United States Patent [19]

Ruppert et al.

[11] Patent Number: 5,749,378

[45] Date of Patent: May 12, 1998

[54] TOBACCO PRODUCT FOR THE SELF-PREPARATION OF A CIGARETTE, ESPECIALLY OF FILTER-TIPPED CIGARETTE AND METHOD OF FORMING THE CIGARETTE

[75] Inventors: Heinrich W. Ruppert; Klaus G. Gätschmann, both of Trossingen, Germany

[73] Assignee: EFKA-Werke Fritz Kiehn GmbH, Germany

[21] Appl. No.: 229,399

[22] Filed: Apr. 18, 1994

Related U.S. Application Data

[63] Continuation of Ser. No. 806,089, Dec. 19, 1991, abandoned.

[30] Foreign Application Priority Data

Dec. 7, 1990 [DE] Germany ..... 40 39 159.0

[51] Int. Cl.[6] ..... A24C 5/02

[52] U.S. Cl. ..... 131/70; 131/71; 131/72; 131/360; 131/365

[58] Field of Search ..... 131/70

[56] References Cited

U.S. PATENT DOCUMENTS

| | | | |
|---|---|---|---|
| 33,889 | 12/1861 | Kneeland . | |
| 236,510 | 1/1881 | Paceholder . | |
| 439,004 | 10/1890 | Harris . | |
| 1,144,824 | 6/1915 | Dula . | |
| 1,165,000 | 12/1915 | Dula . | |
| 1,989,130 | 1/1935 | Brown | 131/52 |
| 3,364,935 | 1/1968 | Moshy et al. | 131/140 |
| 3,633,589 | 1/1972 | Kahane | 131/15 |
| 3,822,710 | 7/1974 | Bramhill | 131/70 |
| 3,902,504 | 9/1975 | Owens, Jr. et al. | 131/2 |
| 3,927,681 | 12/1975 | Bramhill | 131/70 |
| 4,505,282 | 3/1985 | Cogbill et al. | 131/334 |
| 4,510,950 | 4/1985 | Keritsis et al. | 131/353 |

(List continued on next page.)

FOREIGN PATENT DOCUMENTS

| | | |
|---|---|---|
| 52533 | 4/1896 | Canada . |
| 252263 | 8/1915 | Canada . |
| 167536 | 2/1916 | Canada . |
| 771426 | 11/1967 | Canada . |
| 980653 | 12/1975 | Canada . |
| 1018420 | 10/1977 | Canada . |
| 1271389 | 7/1990 | Canada . |

(List continued on next page.)

OTHER PUBLICATIONS

"Tobacco Ruling"—Mar. 12, 1976.

*Primary Examiner*—Aaron J. Lewis
*Assistant Examiner*—Charles W. Anderson
*Attorney, Agent, or Firm*—Andrus, Sceales, Starke & Sawall

[57] ABSTRACT

A tobacco product for self-preparing a cigarette, especially a filter-tipped cigarette, includes a tobacco portion (14) matched with the tobacco filling of a finished cigarette and having an air-permeable outer surface so that it cannot be smoked per se. The outer surface of the tobacco portion is completely smokeable or consumable by smoking, is dimensionally stable and its cross-section and length match the tobacco receiving space (13) of a cigarette paper tube (11) so that the outer surface of the tobacco portion engages the cigarette paper of a cigarette paper tube with the tobacco portion shape retained. An outer bar wrap (15) over the tobacco portion, open at either end, is made of non-smokeable material and transferred from the bar wrap (15) into the paper tube (11). The bar wrap (15) is formed of poorly or non-combustible material such as aluminum-laminate, synthetic plastic film, tin foil, aluminum foil or the like. The tobacco portion is held under compression by the wrap, and upon insertion expands into close engagement with the tube. A binding agent may be added to the system. The wrap's inner surface has a low friction co-efficient to avoid slip-stick effect. The bar wrap may fit in the tube and be withdrawn or abut the end of the tube with the tobacco portion moved into the tube.

13 Claims, 2 Drawing Sheets

U.S. PATENT DOCUMENTS

| | | | |
|---|---|---|---|
| 4,548,677 | 10/1985 | Schneider et al. | 131/365 X |
| 4,622,983 | 11/1986 | Mathews et al. | 131/365 |
| 4,632,131 | 12/1986 | Brunett et al. | 131/355 |
| 4,887,617 | 12/1989 | Ruppert et al. | 131/70 |
| 5,009,237 | 4/1991 | Schmidt et al. | 131/70 |
| 5,018,536 | 5/1991 | Liebich | 131/70 |
| 5,060,674 | 10/1991 | Brown et al. | 131/365 |
| 5,133,366 | 7/1992 | Liebich | 131/70 |
| 5,141,000 | 8/1992 | Ruppert et al. | 131/77 |
| 5,167,241 | 12/1992 | Ruppert et al. | 131/70 |

FOREIGN PATENT DOCUMENTS

| | | |
|---|---|---|
| 143462 | 3/1901 | Germany . |
| 102324 | 11/1916 | Germany . |
| 889578 | 6/1951 | Germany . |
| 822964 | 11/1951 | Germany . |
| 2429783 | 11/1975 | Germany . |
| 7615067 | 5/1976 | Germany . |
| 3149584 | 6/1981 | Germany . |
| 8309186 | 9/1983 | Germany . |
| 8326921 | 12/1983 | Germany . |
| 3244906 | 4/1984 | Germany . |
| 6703935 | 9/1968 | Netherlands . |

TOBACCO PRODUCT FOR THE SELF-PREPARATION OF A CIGARETTE, ESPECIALLY OF FILTER-TIPPED CIGARETTE AND METHOD OF FORMING THE CIGARETTE

This application is a continuation of Ser. No. 07/806,089, filed Dec. 6, 1991, now abandoned.

BACKGROUND OF THE INVENTION

The invention is directed to a tobacco product for the self-preparation of a cigarette, especially a filter-tipped cigarette and to a method of self-preparing cigarettes by making use of the aforementioned tobacco product. The invention is more particularly directed to a filter-tipped cigarette having a tobacco portion which is matched with the tobacco filling of a finished cigarette and which has an air-permeable outer surface so that it cannot be smoked per se. The tobacco portion including its outer surface consists of a material that can be completely smoked and is consumable by smoking. The tobacco portion is dimensionally stable and has its cross-section and length matched with the tobacco receiving space of a cigarette paper tube so that, when inserted, the outer surface is in intimate engagement with the cigarette paper tube for smoking while the prescribed shape of the tobacco portion is retained.

Such a tobacco product has been known, for instance, from DE-C-3407461 or EP-B-155514. Finally, a quite similar proposal is disclosed in EP-A-123150.

Following its introduction on the market, the known tobacco product has had immediate success and is being sold under the tradename WESTPOINT in the Federal Republic of Germany. In other countries, too, this tobacco product has been similarly successful.

The present invention is based on the object of providing an alternative to the above-mentioned tobacco product which is likewise distinguished by extremely simple handling, on the one hand, and by the fact that the cigarette prepared thereby is equivalent to a factory-made cigarette, on the other hand. In particular, it is intended by the alternative according to the present invention to obtain favourable taxation for fine cut also in those countries where the known tobacco product is subjected to taxation similar to that of a factory-made cigarette.

SUMMARY OF THE PRESENT INVENTION

In accordance with the present invention, the above-specified object is solved by inserting the tobacco portion as a prefabricated product within an outer bar wrap which is open at either end and consists of non-smokeable material, especially also poorly or non-combustible material, such that the tobacco portion may be transferred from the bar wrap into the cigarette paper tube while substantially retaining the prescribed shape of the tobacco portion.

Other features and details of this basic principle are more fully disclosed hereinafter and claimed.

It is a further object of the present invention to provide a method of self-preparing cigarettes by using the tobacco product according to the invention. The method of self-preparation of cigarettes with the tobacco product related diameters of the bar wrap and the paper tube includes use of a transfer rod, or alternating blowing and/or drawing out of the tobacco portion into the paper tube. Alternatively, the bar wrapped tobacco portion is inserted into the paper tube and the cigarette formed by withdrawing the outer bar wrap from the tobacco receiving space of the cigarette paper tube and from the tobacco potion while the tobacco portion is firmly held within the cigarette paper tube. Alternatively, a cigarette paper sheet is wrapped about the tobacco product and is glued on as known per se. Subsequently, the outer bar wrap is drawn off the tobacco portion and withdrawn from the wrapped cigarette paper tube.

Thus, the tobacco product according to the present invention is distinguished by the feature that the prefabricated tobacco portion is disposed within an outer bar wrap open at either end and consisting of non-smokable, especially also poorly combustible material, so that the tobacco portion may be transferred from the bar wrap into a cigarette paper tube. The cigarette paper tube may be either prefabricated or prepared by the user by wrapping a piece of cigarette paper around the tobacco portion.

The bar wrap provided in accordance with the invention represents a stuffing means in its simplest form, the unique feature as compared with conventional stuffing devices residing in that the tobacco portion disposed within the bar wrap is dimensionally stable as regards length and cross-section and is intended to retain most of its dimensional stability after transfer into the cigarette paper tube. It is therefore correspondingly easy to transfer the tobacco portion from the bar wrap into the cigarette paper tube, either by blow-ejecting it from the bar wrap and blow-injecting into the cigarette paper tube or by means of a simple transfer rod such as a pencil or the like. If the outer bar wrap is somewhat shorter than the tobacco portion or if the tobacco portion is positioned within the outer bar wrap in such a way that a short length of the tobacco portion projects from one end of the bar wrap, transfer of the tobacco portion from the bar wrap into the cigarette paper tube will be effected by placing the projecting tobacco portion length inside the cigarette paper tube and firmly holding it between two fingers whereafter the bar wrap is withdrawn from the tobacco portion and the tobacco portion is pushed completely into the cigarette paper tube, especially the prefabricated cigarette paper tube.

Preferably, the outer bar wrap is made from poorly combustible paper, especially from paper laminated with aluminium, of the kind provided, for example, for the bar wrap of the tobacco product according to DE-U-8309186 or DE-U-8326921. As compared with the systems proposed by these documents, the tobacco product according to the present invention is characterized in that the tobacco portion may be transferred quite easily from the bar wrap into the cigarette paper tube. In the last-mentioned prior art, the tobacco filling upon transfer from the bar wrap into the cigarette paper tube will expand into the tube so that, on the one hand, a relatively large force is required for the transfer of the tobacco filling and the quality of the prepared cigarette will largely depend on the consistence, especially the moisture content, of the tobacco filling within the bar wrap. Furthermore, a plunger matched with the inner diameter of the bar wrap is required to transfer the tobacco filling from the bar wrap into the cigarette paper tube since otherwise the tobacco filling tends to expand and therefore bind already within the bar wrap when the transfer pressure is applied. This is why a separate transfer device is considered necessary according to DE-U-8326921. Hence, the known system is offered for sale only in combination with said transfer device. But even if such a transfer device is used the aforementioned problems will remain. If the tobacco filling within the bar wrap has become too dry due to conditions of storage, weather or climate, the tobacco on transfer from the bar wrap into the prefabricated cigarette paper tube by means of the ejecting plunger cannot be compressed in the prescribed way and consequently a so-called tobacco beard will protrude from the cigarette paper tube. If, on the other hand, the tobacco stock is too moist, it will be excessively compressed by the ejecting plunger upon transfer from the bar wrap into the cigarette paper tube. In that case the front end portion of the cigarette paper tube will be empty, so that the objective of obtaining a self-prepared cigarette which is equal to a factory-made cigarette cannot be achieved. Frequently, it is found in practical use that the filling immediately in front of the filter tip is highly unsatisfactory even though the transferred tobacco has the proper consistence. None of these problems will occur in the system according to the present invention.

As has been explained above, the tobacco portion is intended largely to retain its dimensional stability. In accordance with a modified embodiment it is proposed that the tobacco portion is disposed within the outer bar wrap under slight radial compression so that, following transfer into the cigarette paper tube, it will closely engage the inner surface thereof due to a corresponding slight radial expansion. Therefore the radial compression of the tobacco portion approximately corresponds to twice the wall thickness of the outer bar wrap. Preferably, it is even slightly less than twice the wall thickness and amounts only to about 50 to 80% of twice the wall thickness of the bar wrap.

Thanks to the outer bar wrap it is now possible to make the wrap for the tobacco portion of extremely thin and correspondingly porous material. The wrap should be just sufficient to confine the tobacco portion. It is preferred that the wrap has a weight of less than 10 g, especially about 8 to 12 g/m$^2$. It consists of cigarette paper or non-woven cellulose which is either porous or provided over the entire length with pores, slits or the like. Either material may be consumed by smoking. Due to the minimum dimensioning of the cigarette paper as regards strength and especially thickness thereof, the smoker will feel that he or she does not have to smoke any additional paper or the like. Of course, the wrap of the tobacco portion may also be formed by a tobacco sheet or even thin tobacco leaves while air permeability of the wrap along the entire length of the tobacco portion must be ensured so as to inhibit any smoking of the tobacco portion per se.

It is preferred that at least the inside of the outer bar wrap has a minimum coefficient of friction caused by appropriate surface finishing or coating so that the tobacco portion can easily be transferred, especially by blowing, for instance, from the bar wrap into the cigarette paper tube.

The outer diameter of the outer bar wrap in one embodiment is approximately equal to the outer diameter of the cigarette paper tube so that the end of the bar wrap may be engaged with a prefabricated cigarette paper tube for transfer of the tobacco portion thereinto. This embodiment ensures a particularly good fit of the transferred tobacco portion within the cigarette paper tube due to the then possible minimum difference in diameter between tobacco portion and cigarette paper tube. At the same time, the simple transfer of the tobacco portion into the cigarette paper tube is not impeded thereby. It is preferred in this case that the tobacco portion is positioned within the outer bar wrap in such a way as to project slightly from one end of the bar wrap.

The outer bar wrap may be manufactured together with the wrap of the tobacco portion. This method is especially suitable when the outer bar wrap has the same length as the tobacco portion and the tobacco portion is flush with the outer bar wrap.

It is, however, likewise conceivable that the outer bar wrap is subsequently machine-wrapped about the tobacco portion in a way similar to filter covering paper for factory-made cigarettes or cigarette paper tubes.

The outer surface of the tobacco portion may be formed by a wrap of a material which is smokable or may be consumed by smoking, respectively, and which exhibits the air permeability required for the non-smokability thereof. As an alternative, the tobacco portion may be confined by binding agents which may be smoked or consumed by smoking, respectively. These alternatives are claimed as essential to the invention in combination with the outer bar wrap as first described above.

The methods described above also represent alternatives, the one by making use of a prefabricated cigarette paper tube and the other one by making use of conventional sheets of cigarette paper.

DESCRIPTION OF DRAWINGS

Below, embodiments of the invention will be described in detail with reference to the accompanying drawing, in which.

DESCRIPTION OF THE ILLUSTRATED EMBODIMENT

Figure 1:
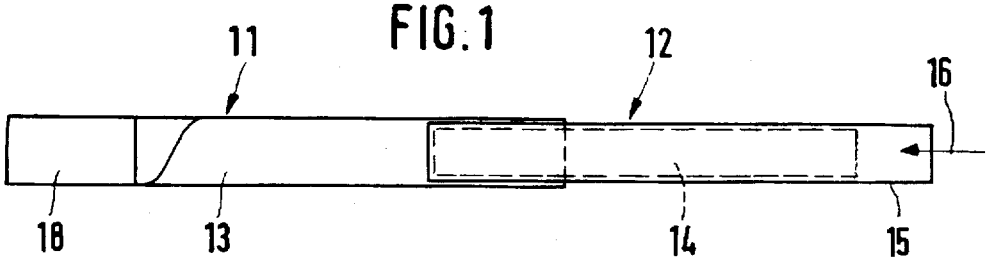
FIG. 1 is a schematic longitudinal section of a first embodiment of the system according to the invention.

In FIG. 1, a prefabricated filter-tipped cigarette paper tube is indicated at 11 into which a tobacco product 12 is inserted which consists of a dimensionally stable tobacco portion 14 of a cross-section and length matched with the tobacco receiving space 13 of the cigarette paper tube 11 and a bar wrap 15 surrounding said portion and consisting of non-smokable, especially non-combustible material. The bar wrap 15 is not provided with any perforations at all so that the tobacco portion 14 may be ejected therefrom and urged into the tobacco receiving space 13 of the cigarette paper tube 11 (see arrow 16). In this case no aids are required for transferring the tobacco portion 14 into the tobacco receiving space 13 of the cigarette paper tube. To facilitate blow-ejection from the bar wrap 15 or blow-injection into the tobacco receiving space 13 of the cigarette paper tube 11, respectively, the bar wrap 15 is somewhat longer than the tobacco portion 14 such that it projects beyond the tobacco portion 14 at the free end, i.e. the right-hand end in FIG. 1. In this way a kind of blow mouthpiece is provided.

It is preferred that the inner surface of the bar wrap 15 should be treated for a reduction of the coefficient of friction so that the tobacco portion 14 can easily be blown out of the bar wrap 15 and into the cigarette paper tube 11. Of course, transfer of the tobacco portion 14 may also be effected by a rod-like device, wherein the diameter of such a rod may be considerably smaller than the inner diameter of the bar wrap 15. The reason is that the transfer of the tobacco portion 14 from the bar wrap 15 into the tobacco receiving space 13 of the cigarette paper tube 11 is effected with practically no resistance.

Figure 2:
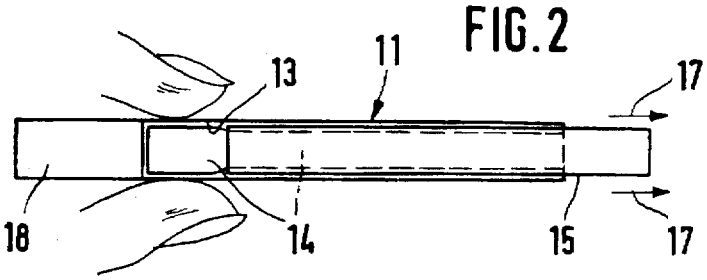
FIG. 2 is a schematic longitudinal section of a second embodiment of the system according to the invention.

The embodiment illustrated in FIG. 2 is characterized in that the tobacco portion 14 projects slightly from one end of the bar wrap 15 beyond the same so that the projecting length of the tobacco portion 14 may be held between two fingers within the tobacco receiving space 13. Thereafter, the bar wrap 15 can be withdrawn from the cigarette paper tube 11 in the direction of the arrows 17. Here, the tobacco portion 14 is retained within the cigarette paper tube 11. In this embodiment the tobacco portion 14 may also be disposed within the outer bar wrap 15 under some radial compression so that after removal of the bar wrap 15 it will slightly expand radially within the cigarette paper tube 11 so as to become closely engaged with the inner surface thereof.

Furthermore, this embodiment is also suited for a tobacco portion which is held together by binding agents that can be smoked or consumed by smoking, respectively. With the embodiment according to FIG. 1, on the other hand, it would be suitable to define the outer surface of the tobacco portion by a wrap made of a material such as cigarette paper, non-woven cellulose, tobacco sheet or the like which can be smoked or consumed by smoking, the permeability of the wrap to air being such that the tobacco portion as such, i.e. outside of the cigarette paper tube, cannot be smoked. It is preferred that at least the outer surface of the tobacco portion wrap is somewhat fur-like whereby friction between the bar wrap and the tobacco portion is reduced additionally so that the transfer from the bar wrap into the tobacco receiving space of the cigarette paper tube is facilitated further.

Basically, it should be noted that in the case of the embodiment of the tobacco portion with a wrap the latter is made of cigarette paper or non-woven cellulose which is porous or provided along its entire length with pores, slits or the like, said paper or non-woven material having a thickness which is just sufficient to hold the conventionally compressed tobacco filling together. Accordingly, the consumer is required to smoke only a minimum amount of additional paper or the like. Of course, the cigarette paper tube also may be made of cigarette paper which is thinner than in the prior art, so that in total the consumer will not smoke more cigarette paper than in the case of conventional cigarettes, be they factory-made or self-prepared. The bar wrap (15) may be formed of poorly or non-combustible material such as aluminum-laminate, synthetic plastic film, tin foil, aluminum foil or the like.

It is preferred that the wrap should have a weight of less than 10 g, especially only about 8–12 g/cm$^2$. Provided the minimum required strength of the wrap permits, the weight may also be less than 8 g/cm$^2$.

A filter tip of approximately equal cross-section may also be inserted at the face of the tobacco portion 14. This embodiment will be of particular interest when the tobacco product is to be wrapped with a conventional cigarette paper sheet. In that case it is also possible to make a filter cigarette by using a cigarette paper sheet.

In the embodiment according to FIG. 2, in which the tobacco portion is held together either by internal binders or by a wrap of the above-described kind, the tobacco portion is preferably compressed within the outer bar wrap 15 in such a way that due to the radial expansion outside of the outer bar wrap 15 the tobacco portion 14 adopts a diameter which corresponds approximately to the outer diameter of the outer bar wrap 15 or the inner diameter of the cigarette paper tube 11, respectively, or which is but slightly, i.e. by 1/20 to 3/10 mm, smaller than said diameter.

To permit pushing of the tobacco product into the tobacco receiving space 13 of a prefabricated cigarette paper tube, the outer diameter of the bar wrap 15 is slightly smaller, especially by about 1/20 to 2/10 mm, than the inner diameter of the cigarette paper tube 11, wherein the outer diameter of the tobacco portion 14 may be smaller by up to about 3/10 mm than the inner diameter of the cigarette paper tube. In that case proper smoking of the tobacco portion in the cigarette paper tube 11 is still possible, while it is ensured at the same time that the tobacco portion 14 will not accidentally drop from the cigarette paper tube 11.

Figure 3:
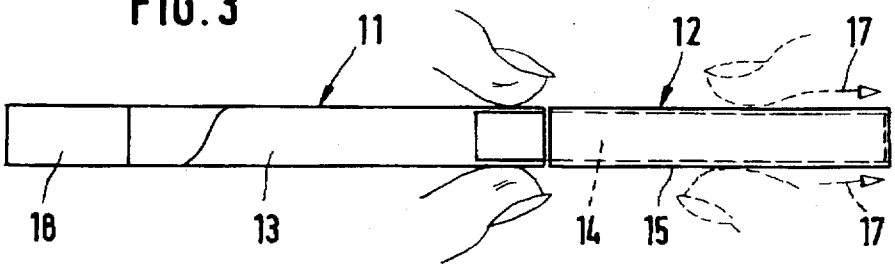
FIG. 3 is a schematic longitudinal section of a third embodiment of the system according to the invention.

In the embodiment illustrated in FIG. 3 the outer diameter of the outer bar wrap 15 is approximately equal to the outer diameter of the cigarette paper tube 11, so that the bar wrap 15 is engaged endwise as shown in FIG. 3 for the purpose of transferring the tobacco portion 14 into a prefabricated cigarette paper tube. For transferring the tobacco portion 14 into the tobacco receiving space 13 of the cigarette paper tube 11, the bar wrap 15 is dimensioned to be slightly shorter than the tobacco portion 14 so that the latter projects from one end beyond the bar wrap 15. The projecting length of tobacco portion 14 is fitted for transfer purposes into the tobacco receiving space as shown in FIG. 3 and is then firmly held between two fingers. Thereupon the bar wrap 15 can easily be withdrawn from the tobacco portion 14. Subsequently, the cigarette paper tube 11 is held by one hand in the vicinity of the filter tip 18, while the other hand, pushes the tobacco portion 14 completely into the tobacco receiving space 13 of the cigarette paper tube 11. This embodiment is also suited for a tobacco portion 14 which is disposed inside the bar wrap 15 under slight compression. It is preferred that the bar wrap 15 is wrapped later around the tobacco portion 14, for example like with the filter-coated paper of a factory-made cigarette or factory-made filter-tipped cigarette paper tube.

Figure 4:
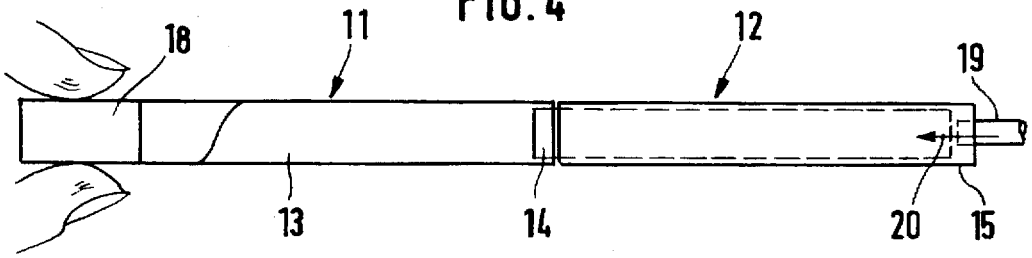
FIG. 4 is a schematic longitudinal section of a fourth embodiment of the system according to the invention.

The embodiment illustrated in FIG. 4 differs from that shown in FIG. 3 in that the transfer of the tobacco portion 14 from the bar wrap 15 into the tobacco receiving space 13 of the prefabricated cigarette paper tube 11 is effected by means of a rod-like member 19 in the direction of the arrow 20. In this embodiment, the bar wrap 15 has approximately the same length as the tobacco portion 14, wherein the tobacco portion 14 prior to the transfer into the tobacco receiving space of the cigarette paper tube 11 terminates flush with the two ends of the bar wrap 15. For the purpose of transfer into the tobacco receiving space 13 the tobacco portion 14 is then first pushed some way from the bar wrap 15 by means of the rod 19. Then, the projecting length of the tobacco portion 14 is inserted into the front end of the cigarette paper tube 11. Subsequently, the tobacco portion 14 may be transferred in a way similar to that shown in FIG. 3. However, it is also possible to continue transfer of the tobacco portion 14 by means of the rod 19. It is unnecessary for the rod 19 to have a diameter which would somewhat correspond to the inner diameter of the bar wrap 15. It may be considerably smaller because the tobacco portion 14 is dimensionally stable, on the one hand, and is relatively easy to push out of the bar wrap 15, on the other hand.

The afore-described examples have been illustrated in combination with a factory-made prefabricated cigarette paper tube. It would also be possible initially to wrap a cigarette paper sheet about the tobacco product 12 and then to glue the sheet on as known per se. Subsequently, the outer bar wrap 15 is drawn off the tobacco portion or drawn out from the cigarette paper tube made by wrapping. Of course, the last-mentioned process requires more effort than the system with a prefabricated cigarette paper tube; nevertheless it is possible with sufficient skill to prepare a proper cigarette with a cigarette paper sheet by making use of the tobacco product according to the invention.

Figure 5A:
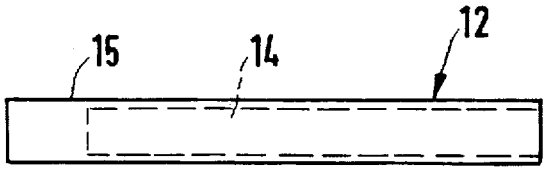
FIGS. 5*a* to 5*b* are schematic side views illustrating various possibilities for a tobacco product according to the invention.

FIGS. 5*a*–5*d* illustrate four embodiments of the tobacco product 12 of the present invention which differ in respect of the length of the bar wrap 15. In the embodiment illustrated in FIG. 5*a*, the bar wrap 15 is dimensioned to be longer than the tobacco portion 14, and the tobacco portion 14 is disposed within the outer bar wrap 15 in such a way that one end of the tobacco portion 14 is flush with one end of the bar wrap 15, i.e. the right-hand end thereof as seen in FIG. 5*a*.

Figure 5B:
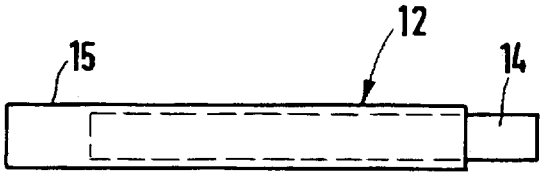

In the embodiment of FIG. 5*b*, the bar wrap 15 has approximately the same length as the tobacco portion 14. However, the tobacco portion 14 is disposed within the bar wrap 15 in such a way as to project beyond the bar wrap 15 from one end thereof.

Figure 5C:
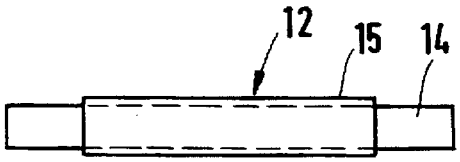

In the embodiment of FIG. 5*c*, the bar wrap 15 is made shorter than the tobacco portion 14. Also, the tobacco portion 14 is placed within the bar wrap 15 in such a way as to project therefrom at either end thereof.

Figure 5D:
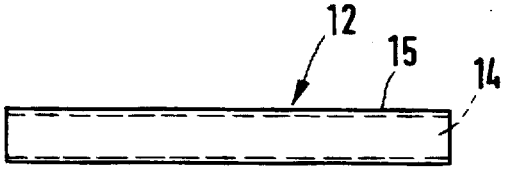

In the embodiment of FIG. 5*d*, the length of the bar wrap 15 is equal to the length of the tobacco portion 14, and the tobacco portion 14 is fully disposed within the bar wrap 15. In this embodiment the tobacco product 12 may be prepared in a single operation on a modified cigarette making machine.

Furthermore, the outer bar wrap 15 offers the advantage of additionally keeping the tobacco moist. Also, it represents an additional mechanical protection for the tobacco portion 14. For the rest, it is the simplest form of cigarette stuffing means.

Figure 6:
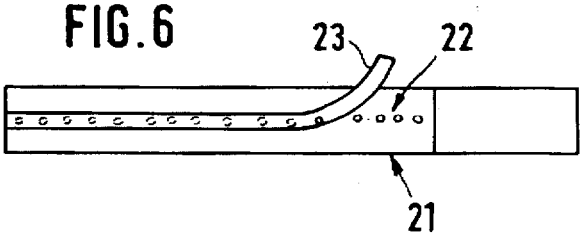
FIG. 6 is a schematic view illustrating another alternative to the prior known tobacco product.

Finally, the alternative illustrated in FIG. 6 should be pointed out. This is characterized by a factory-made cigarette, especially a filter-tipped cigarette 21, the cigarette paper tube of which is provided with a perforated line extending along the entire length of the tobacco receiving space such that the cigarette cannot be smoked. The cigarette will become smokable only when the perforated line is covered with a gummed strip of cigarette paper 23, which means that said strip must be glued over the perforated line prior to smoking of the cigarette 21. The aforementioned system therefore comprises a longitudinally perforated cigarette 21 and an associated cigarette paper strip 23. Due to the fact that the thus configured cigarette is unsmokable it has to be regarded as fine cut from the viewpoint of taxation. This fine cut which is packaged in portions will only become a cigarette when the paper strip 23 has been glued over the perforated line 22. The product prepared in this way cannot be distinguished from a factory-made cigarette. The last-mentioned embodiment is considered to be a separate invention and is claimed as such.

All of the features disclosed in the present papers are claimed as being essential to the invention to the extent to which they are novel over the prior art either individually or in combination.

We claim:

1. A tobacco product for the self-preparation of a cigarette including a filter-tipped cigarette, including a cigarette paper tube (11) having a cylindrical tobacco receiving space (13) including a prescribed cross section and length similar to a factory prepared cigarette, comprising a cylindrical tobacco portion (14) for filling of said cigarette paper tube and having an air permeable outer surface preventing combustion and smoking of the tobacco portion per se and wherein the tobacco portion (14) includes an outer surface consisting of completely smokable material, and wherein the tobacco portion (14) is dimensionally stable with a prescribed cylindrical shape and has a cross-section and length matched with the tobacco receiving space (13) of said cigarette paper tube (11) with the outer surface of the tobacco portion in intimate engagement with the interior surface of the cigarette paper tube for smoking while the prescribed cylindrical shape of the tobacco portion is retained, the improvement comprising an outer bar wrap (15) surrounding the tobacco portion (14) as a prefabricated product for assembly with said cigarette paper tube, said bar wrap being open at either end, and formed of a non-smokable material, said tobacco portion (14) and said bar wrap (15) being constructed and arranged for ready movement of said tobacco portion from said bar wrap in said dimensionally stable state by applying a relatively low force to one end of said tobacco portion relative to said bar wrap whereby said tobacco portion is manually transferable from said bar wrap (15) directly into said cigarette paper tube (11) without necessity of auxiliary force applying devices while substantially retaining the prescribed cylindrical shape of said tobacco portion and said bar wrap.

2. The tobacco product of claim 1, wherein said bar wrap (15) is an aluminum-laminated material.

3. The tobacco product of claim 1, wherein said outer bar wrap (15) consists of transparent sheet material.

4. The tobacco product of claim 1, wherein said outer bar wrap (15) consists of synthetic plastic film, tin foil or aluminum foil.

5. The tobacco product of claim 1, wherein said tobacco portion (14) is placed within the outer bar wrap (15) with at least one end of the tobacco portion (14) flush with an end of the bar wrap (15).

6. The tobacco product of claim 1, wherein said outer wrap (15) is longer than the tobacco receiving space (13) of the cigarette paper tube (11).

7. The tobacco product of claim 1, wherein said tobacco portion (14) is disposed within the outer bar wrap (15) under slight radial compression whereby upon transfer into the cigarette paper tube (11), the tobacco portion (14) intimately engages the inner surface of said cigarette paper tube under corresponding slight radial expansion.

8. The tobacco portion of claim 7, wherein said tobacco portion is slightly compressed within said bar wrap (15) and has a radial expansion upon removal from the outer bar wrap (15) sufficient to adopt a diameter which corresponds substantially to the outer diameter of the outer bar wrap (15) and thereby substantially the inner diameter of the cigarette paper tube (11) upon transfer to said paper tube.

9. The tobacco product of claim 1, wherein said outer surface of the tobacco portion (14) consists of a wrap consumable by smoking, and selected from the group of cigarette paper, non-woven cellulose, tobacco sheet, and thin tobacco leaf, said wrap having an air permeability preventing the tobacco portion (14) from being smoked per se.

10. The tobacco product of claim 9, wherein said wrap includes cigarette paper and is selected from the group of non-woven cellulose and with air passageway means along the entire length thereof and having a thickness just sufficient to confine the tobacco portion 14.

11. The tobacco product of claim 10, wherein said wrap of the tobacco portion (14) weighs approximately 8–12 $g/m^2$.

12. The tobacco portion of claim 1, wherein at least the inside of the outer bar wrap (15) has a reduced coefficient of friction to avoid slip-stick effect.

13. The tobacco portion of claim 1, wherein the outer diameter of said outer bar wrap (15) is slightly smaller on the order of about 1/20 to 2/10 mm, than the inner diameter of the cigarette paper tube (11), and the outer diameter of the tobacco portion (14) is smaller up to substantially 3/10 mm than the inner diameter of the cigarette paper tube (11).

* * * * *